US005974983A

United States Patent [19]

Bogucki

[11] Patent Number: 5,974,983

[45] Date of Patent: Nov. 2, 1999

[54] TABLE TOP LIFT

[75] Inventor: Peter Bogucki, Kings Park, N.Y.

[73] Assignee: Infra-Structures, Inc., Brentwood, N.Y.

[21] Appl. No.: 08/919,046

[22] Filed: Aug. 27, 1997

[51] Int. Cl.[6] ..... A47B 9/00

[52] U.S. Cl. ..... 108/147; 312/208.1

[58] Field of Search ..... 108/144, 147, 108/147.16, 147.17, 50.01, 50.02; 312/208.1, 223.3, 306

[56] References Cited

U.S. PATENT DOCUMENTS

| | | | |
|---|---|---|---|
| 4,790,611 | 12/1988 | Craner | 312/306 |
| 5,071,204 | 12/1991 | Price et al. | 312/223.3 X |
| 5,287,815 | 2/1994 | Gross | 312/208.1 X |
| 5,322,025 | 6/1994 | Sherman et al. | 108/147 |
| 5,408,940 | 4/1995 | Winchell | 108/147 |
| 5,598,788 | 2/1997 | Jonker | 108/147 |
| 5,598,789 | 2/1997 | Jonker | 108/147 |

*Primary Examiner*—Jose V. Chen
*Attorney, Agent, or Firm*—Bauer & Schaffer, LLP

[57] ABSTRACT

A device for automatically adjusting the height of a keyboard table of a console enclosure so as to allow the keyboard table to automatically be at an elevation comfortable for various users. The console enclosure has a hollow base that contains a pair of spaced-apart and vertically-oriented partitions each of which has a pair of throughslots that are vertically-spaced-apart, horizontally-oriented, and generally oblong-shaped. A pair of sub-units that are interchangeable and opposing are mounted respectively to the pair of partitions. Each of the sub-units include a track, a stationary frame, a movable frame, and apparatus. The track is replaceably mounted to a respective partition of the pair of partitions. The stationary frame is fixedly disposed in the track. The movable frame is mounted in the track for vertical movement therein and replaceably attaches the keyboard table thereto for vertical movement therewith.

22 Claims, 4 Drawing Sheets

TABLE TOP LIFT

BACKGROUND OF THE INVENTION

1. Field of the Invention

The present invention relates to a device for adjusting the height of a computer keyboard table. More particularly, the present invention relates to a device for automatically adjusting the height of a keyboard table of a console enclosure so as to allow the keyboard table to automatically be at an elevation comfortable for various users of the same console enclosure without having to manually remove and relocate the keyboard table.

2. Description of the Prior Art

To date numerous innovations for work stations have been provided in the prior art that will be described.

For example, U.S. Pat. No. 4,590,866 to Schairbaum, and its Canadian counterpart 1,236,872, U.S. Pat. No. 4,755,09 and U.S. Pat. No. 4,869,564, teach construction of a computer work station in which a work table has a horizontal work surface, having a CRT and a keyboard resting upon the table.

Even though these innovations may be suitable for the specific individual purposes to which they address, however, the majority of these systems have been intended for a single work station or a few isolated work stations. These systems are not intended, nor suited, to be used in large scale aviation or military settings where there may be tens of work stations ganged together in relatively small confines. Such installations are intended for virtual continuous use with one operator replacing another without the need for resetting and readjusting of the electronic components between shifts.

Those systems that have been proposed for use in larger applications tend to be complex in construction and expensive. Also, the prior art has been limited in the number of console structures and shapes that could be achieved utilizing their elemental components. The prior art has also been limited in the size and variety of computer equipment they could accommodate, as well as the ability to set up such stations for the most convenient use by several individual operators.

A particular problem found in the prior art is the absence of an easy and effective way of adjusting the level of the monitor and of the keyboard to suit a variety of operators, especially when the individual consoles are to be used by more than one operator.

In our copending application Ser. No. 08/842,439, filed Apr. 24, 1997, we attempt to overcome this problem by teaching construction of a console enclosure for supporting various computer or electronic components that contains an adjustable supporting table for a monitor, while having a keyboard table that is adjustable and a shielding canopy. The keyboard table is supported on a pair of gussets whose vertical edges have keys extending therefrom that cooperatively engage with spaced slots in associated corner posts. To adjust the height of the keyboard table, the keys of the gusset plates are disengaged from their associated slots and relocated into other slots at the required height.

Even though this arrangement overcomes the short comings of the prior art, by allowing the keyboard table to be height adjustable, the keyboard table must be physically removed and relocated for its height adjustment.

SUMMARY OF THE INVENTION

An object of the present invention is to provide a device for automatically adjusting the height of a keyboard table of a console enclosure that avoids the disadvantages of the prior art.

Another object of the present invention is to provide a device for automatically adjusting the height of a keyboard table of a console enclosure that is simple and inexpensive to manufacture.

Still another object of the present invention is to provide a device for automatically adjusting the height of a keyboard table of a console enclosure that is simple to use.

These objects as well as others, together with the numerous advantages, are set forth in the following disclosure. Yet another object of the present invention is to provide a device for automatically adjusting the height of a keyboard table of a console enclosure so as to allow the keyboard table to automatically be at an elevation comfortable for various users of the same console enclosure without having to manually remove and relocate the keyboard table. The console enclosure has a hollow base that contains a pair of spaced-apart and vertically-oriented partitions each of which has a pair of throughslots that are vertically-spaced-apart, horizontally-oriented, and generally oblong-shaped. The device includes a pair of sub-units that are interchangeable and opposing and are for mounting to the pair of partitions. Each of the sub-units include a track, a stationary frame, a movable frame, and apparatus. The track is for replaceably mounting to a respective partition of the pair of partitions. The stationary frame is fixedly disposed in the track. The movable frame is mounted in the track for vertical movement therein and for replaceably attaching the keyboard table thereto for vertical movement therewith. The apparatus automatically and selectively moves the movable frame and the keyboard table replaceably attached thereto vertically so as to allow the keyboard table to automatically be at the elevation comfortable for the various users of the same console enclosure without having to manually remove and relocate the keyboard table.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

DETAILED DESCRIPTION OF THE PREFERRED EMBODIMENT

Figure 1:
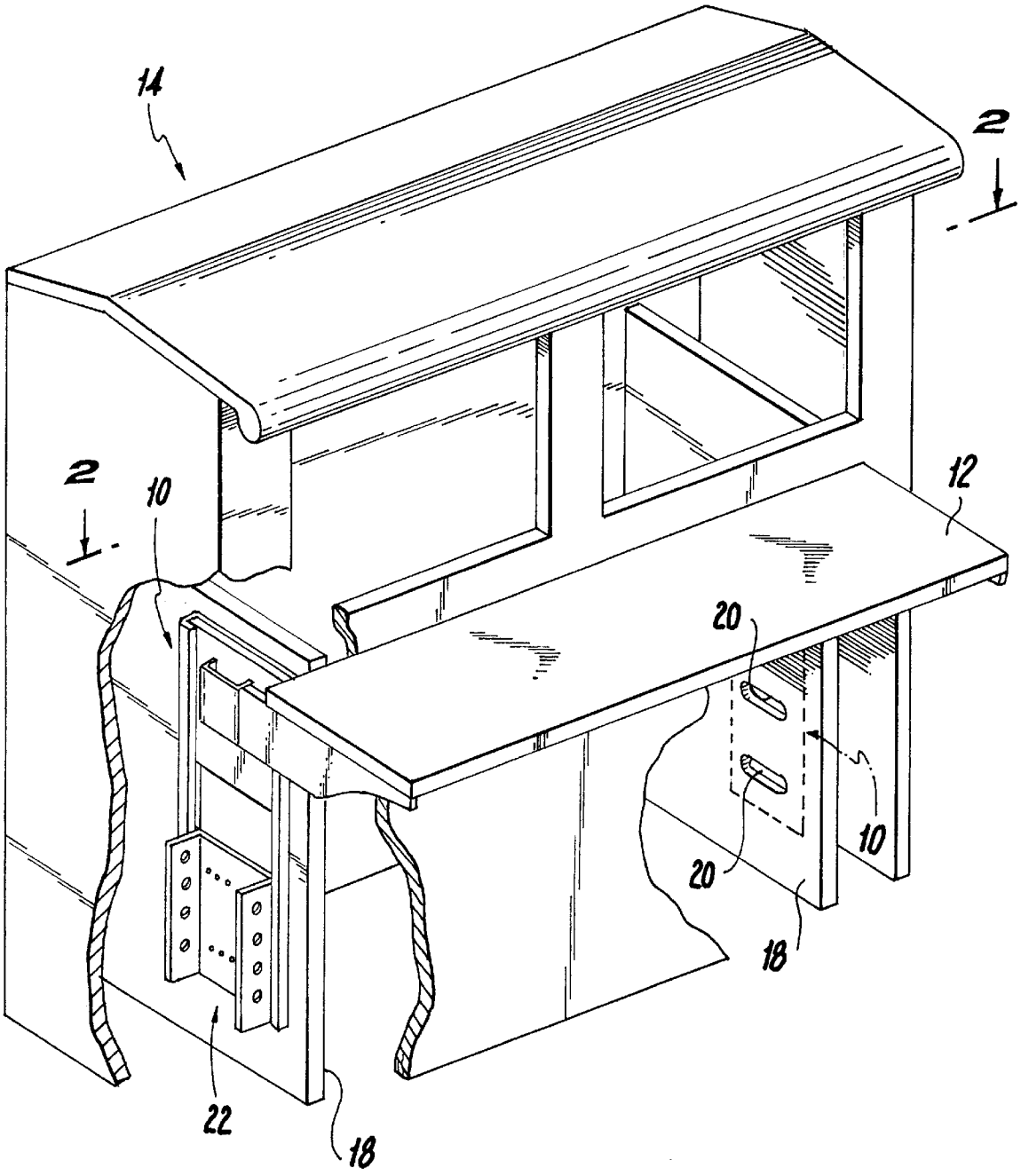
FIG. 1 is a diagrammatic perspective view of a typical console enclosure with the present invention installed therein.
Figure 2:
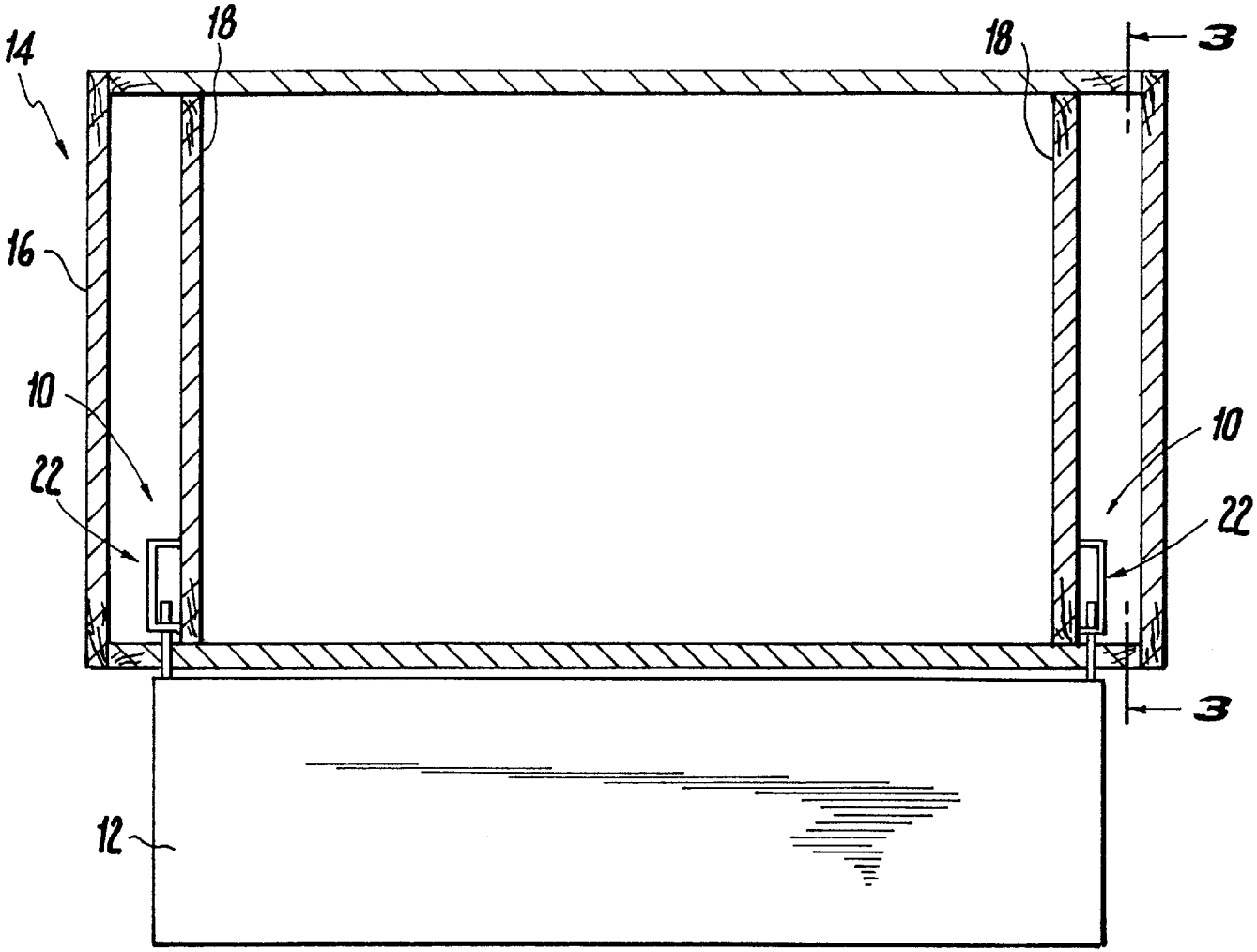
FIG. 2 is an enlarged diagrammatic cross sectional view taken on line 2—2 in FIG. 1.

Referring now to the figures in which like numerals indicate like parts, and particularly to FIG. 1 and FIG. 2, the device for automatically adjusting the height of a keyboard table of a console enclosure of the present invention is shown generally at 10 for allowing a keyboard table 12 of a console enclosure 14 to automatically be at an elevation comfortable for various users of the same console enclosure 14 without having to manually remove and relocate the keyboard table 12.

It is to be noted that the console enclosure 14 may be of the type taught in our copending application Ser. No. 08/842,439, filed Apr. 24, 1997 and incorporated herein by reference, or can in the alternative, be any other work station adapted for use without departing in any way from the spirit of the present invention.

The console enclosure 14 has a hollow base 16 containing a pair of partitions 18 that are spaced-apart and vertically-oriented, with each of which having a pair of throughslots 20 therethrough that are vertically-spaced-apart, horizontally-oriented, and generally oblong-shaped.

The device for automatically adjusting the height of a keyboard table of a console enclosure 10 comprises a pair of sub-units 22 that are interchangeable and oppositely arranged and are for mounting to the pair of partitions 18 in the hollow base 16 of the console enclosure 14.

Figure 3:
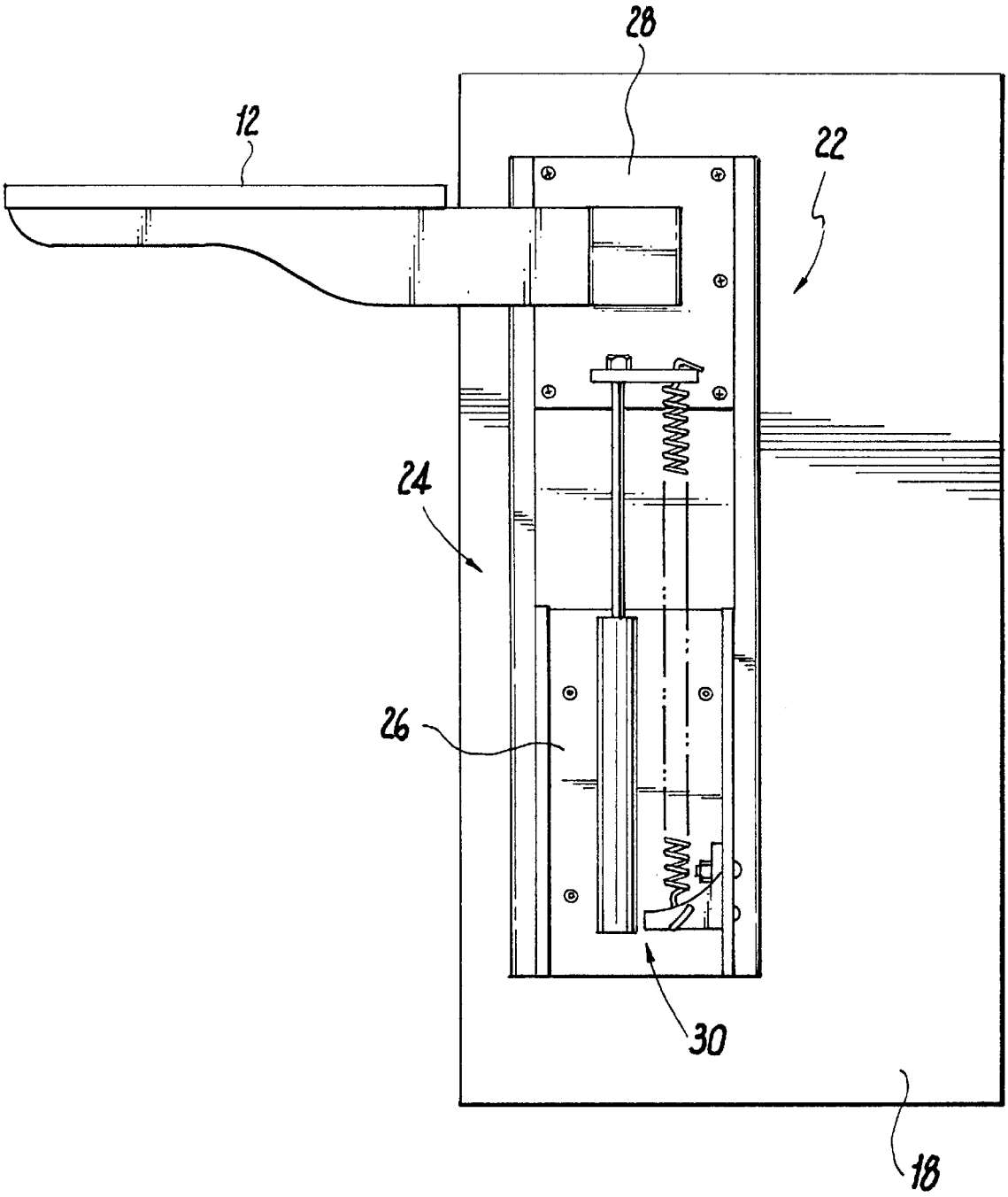
FIG. 3 is an enlarged diagrammatic side elevational view of the present invention taken generally in the direction of ARROW 3 in FIG. 2.

The general configuration of the device for automatically adjusting the height of a keyboard table of a console enclosure 10 can best be seen in FIG. 3, and as such will be discussed with reference thereto.

Each sub-unit of the pair of sub-units 22 comprises a track 24 for replaceably mounting to a respective partition of the pair of partitions 18 in the hollow base 16 of the console enclosure 14, a stationary frame 26 fixedly disposed in the track 24, a movable frame 28 mounted in the track 24 for vertical movement therein and for having the keyboard table 12 replaceably attached thereto for vertical movement therewith, and apparatus 30 for automatically and selectively moving the movable frame 28 and the keyboard table 12 replaceably attached thereto vertically so as to allow the keyboard table 12 to automatically be at the elevation comfortable for the various users of the same console enclosure 14 without having to manually remove and relocate the keyboard table 12.

Figure 4:
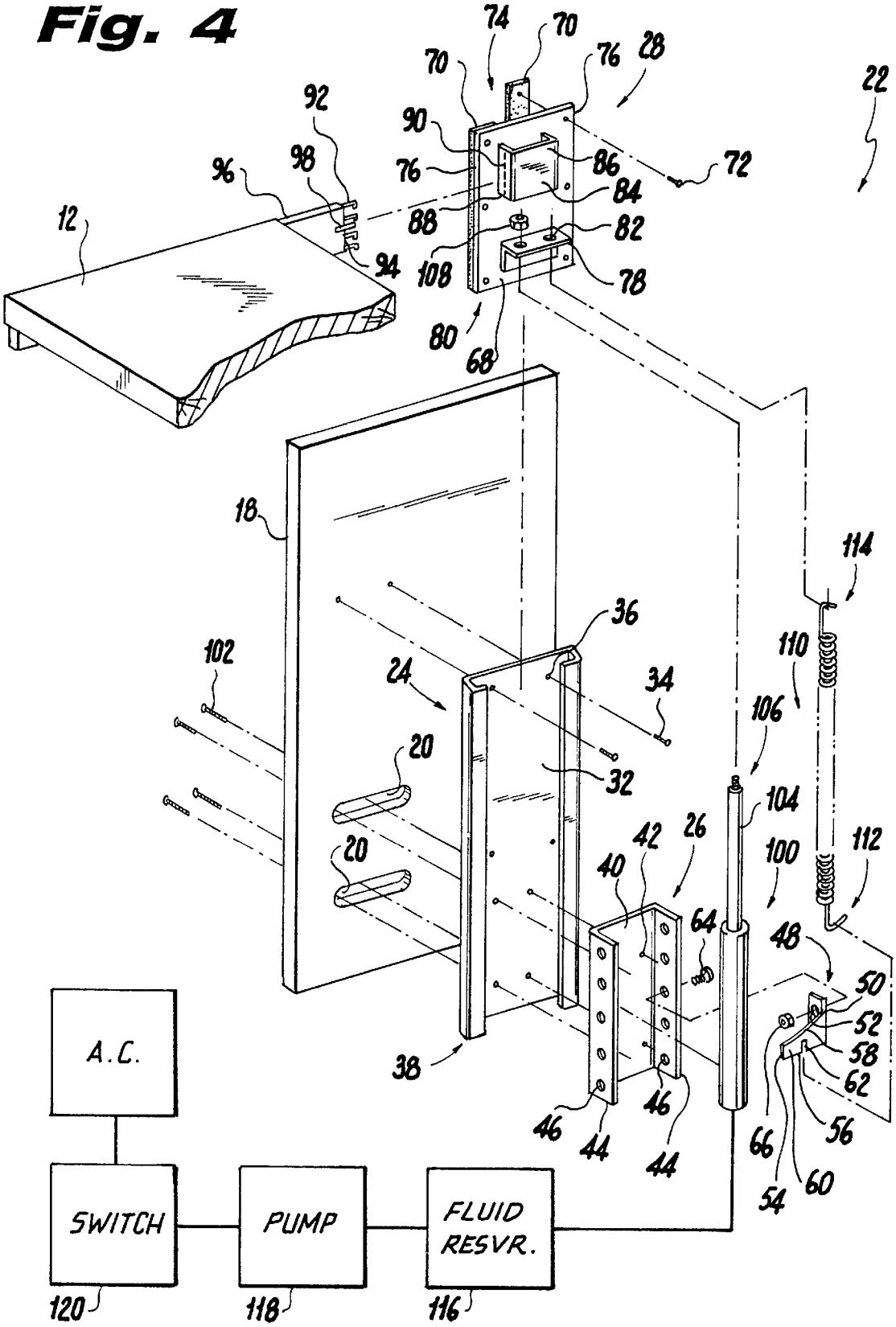
FIG. 4 is an exploded diagrammatic perspective view of the present invention shown in FIG. 3.

The specific configuration of the track 24 can best be seen in FIG. 4, and as such will be discussed with reference thereto.

The track 24 is substantially C-shaped, vertically-oriented, and whose web 32 abuts against, and is for replaceably mounting to, a respective partition of the pair of partitions 18, by screws 34 passing through throughbores 36 therealong.

The specific configuration of the stationary frame 26 can best be seen in FIG. 4, and as such will be discussed with reference thereto.

The stationary frame 26 is vertically-oriented and channel-shaped and disposed in the track 24, at its lower end 38, and whose web 40 faces the web 32 of the track 24 and has four pair of throughbores 42 therethrough with each two pair being horizontally-aligned and vertically spaced apart, and whose pair of flanges 44 extend perpendicularly inwardly from the web 40 of the stationary frame 26, past, and are affixed to, the track 24, preferably by welding, with the pair of flanges 44 of the stationary frame 26 extending past the track 24 so as to protect at least a portion of the apparatus 30 from inadvertent damage.

Each flange of the pair of flanges 44 of the stationary frame 26 has a plurality of throughbores 46 therethrough that are longitudinally spaced therealong and together with the four pair of throughbores 42 in the web 40 of the stationary frame 26 allow the same stationary frame 26 to be interchangeably used on either partition of the pair of partitions 18 so as to reduce manufacturing costs and storage of spare parts.

The stationary frame 26 further comprises a lower spring retainer 48 that has a mounting portion 50 that is flat and vertically-oriented with a plurality of throughbores 52 therethrough that are longitudinally spaced therealong, and a retainer portion 54 that extends perpendicularly horizontally inwardly from the mounting portion 50 of the lower spring retainer 48 of the stationary frame 26, at its lower end 56, and has an upper edge 58 that is concave-shaped and a lower edge 60 with a vertical notch 62 therein.

The mounting portion 50 of the lower spring retainer 48 of the stationary frame 26 abuts against, and is adjustably affixed to, a rearmost flange of the pair of flanges 44 of the stationary frame 26, by bolts 64 passing through the plurality of throughbores 52 in the mounting portion 50 of the lower spring retainer 48 of the stationary frame 26 and through an aligned set of throughbores of the plurality of throughbores 46 in the rearmost flange of the pair of flanges 44 of the stationary frame 26 and threadably engage nuts 66, with the retainer portion 54 of the lower spring retainer 48 of the stationary frame 26 extending towards a forwardmost flange of the pair of flanges 44 of the stationary frame 26.

The specific configuration of the movable frame 28 can best be seen in FIG. 4, and as such will be discussed with reference thereto.

The movable frame 28 comprises a plate 68 that is vertically-oriented and slidably mounted for vertical movement in the track 24 above the stationary frame 26, and a pair of friction reducing bars 70, typically TEFLON, that are slender and replaceably affixed by screws 72 to the plate 68 of the movable frame 28, on its back side 74 and at its long edges 76, and which contact the track 24 so as to facilitate vertical movement of the movable frame 28 in the track 24.

The plate 68 of the movable frame 28 has a ledge 78 on its lower portion 80 that is horizontally-oriented and pressed out therefrom so as to reduce manufacturing costs, and which faces away from the track 24 and has pair of throughbores 82 therethrough that are spaced longitudinally therealong.

The movable frame 28 further comprises a keyboard table engaging member 84 that is vertically-oriented and channel-shaped and whose web 86 is narrower than, and spaced parallel from, the plate 68 of the movable frame 28 and whose pair of flanges 88 extend perpendicularly outwardly therefrom and are fixedly attached to the plate 68 of the movable frame 28, preferably by welding, at a position vertically centered thereon, above and on the same face as, the ledge 78 of the plate 68 of the movable frame 28.

Each flange of the pair of flanges 88 of the keyboard table engaging member 84 has a plurality of throughslots 90 therethrough that are longitudinally spaced therealong so as to allow the same movable frame 28 to be interchangeably used on either partition of the pair of partitions 18 and further reduce manufacturing costs and storage of spare parts, and with the plurality of throughslots 90 in a forwardmost flange of the pair of flanges 88 of the keyboard table engaging member 84 for replaceably receiving cooperating keys 92 on a vertical edge 94 of a respective gusset plate of a pair of gusset plates 96 that support the keyboard table 12.

The plurality of throughslots 90 in each flange of the pair of flanges 88 of the keyboard table engaging member 84 are preferably five, four for replaceably receiving the cooperating keys 92 on the vertical edge 94 of the respective gusset plate of the pair of gusset plates 96 and a center one for lockingly receiving a sliding lock 98 extending from the respective gusset plate of the pair of gusset plates 96 for releasably maintaining the cooperating keys 92 in the four throughslots of the plurality of throughslots 90 so as to prevent inadvertent removal of the keyboard table 12.

The specific configuration of the apparatus 30 can best be seen in FIG. 4, and as such will be discussed with reference thereto.

The apparatus 30 comprises an hydraulic cylinder 100 that is vertically-oriented and replaceably mounted to the web 40 of the stationary frame 26, parallelably between, and closest to a fowardmost flange of, the pair of flanges 44 of the stationary frame 26, by screws 102 passing through and accessible from the pair of throughslots 20 in the respective partition of the pair of partitions 18 and through associated throughbores of the four pair of throughbores 42 in the web 40 of the stationary frame 26 so as to facilitate access to the screws 102 when the hydraulic cylinder 100 requires replacement without having to remove the sub-unit 22 from the associated partition of the pair of partitions 18, and with the hydraulic cylinder 100 being mounted closest to the fowardmost flange of the pair of flanges 44 of the stationary frame 26 so as to better absorb pressure imparted on the keyboard table 12 by the various users.

The hydraulic cylinder 100 has a piston rod 104 with a free end 106 that is threaded and enters into a forwardmost throughbore of the pair of throughbores 82 in the ledge 78 of the plate 68 of the movable frame 28 and is replaceably maintained therein by a pair of nuts 108 that straddle the ledge 78 of the plate 68 of the movable frame 28 so as the piston rod 104 of the hydraulic cylinder 100 is extended, the movable frame 28 and the keyboard table 12 replaceably attached thereto automatically rises.

The apparatus 30 further comprises a coil spring 110 that is vertically-oriented and disposed parallelably between, and closest to a rearmost flange of, the pair of flanges 44 of the stationary frame 26, with a lowermost end 112 thereof replaceably engaging the vertical notch 62 in the lower edge 60 of the retainer portion 54 of the lower spring retainer 48 of the stationary frame 26, with the upper edge 58 of the retainer portion 54 of the lower spring retainer 48 of the stationary frame 26 providing clearance for a lowermost coil of the coil spring 110, and with an uppermost end 114 of the coil spring 110 replaceably engaging a rearmost throughbore of the pair of throughbores 82 in the ledge 78 of the plate 68 of the movable frame 28 so as the hydraulic cylinder 100 is relieved, the biasing of the coil spring 110 causes the piston rod 104 of the hydraulic cylinder 100 to retract and automatically lower the movable frame 28 and the keyboard table 12 replaceably attached thereto.

The plurality of throughbores 46 in the rearmost flange of the pair of flanges 44 of the stationary frame 26 allow the mounting portion 50 of the lower spring retainer 48 of the stationary frame 26 to be selectively mounted at any elevation on the rearmost flange of the pair of flanges 44 of the stationary frame 26 so as to allow springs of different tensions and lengths to be used.

The apparatus 30 further comprises a fluid reservoir 116, typically of the type sold by MONARCH HYDRAULICS, INC., Dyna-lift Group, Grand Rapids, Mich. 49503, under model no. 2E-DIA-06-S and serial no. 3818, that is in fluid communication with the hydraulic cylinder 100, and a pump 118, typically of the type sold by HUBBELL SPECIAL PRODUCTS, INC., Kenosha, Wis. 53144, under model no. MC 42- 1014H, that is operatively connected to the reservoir 116 and which is for being powered by a typical AC power source.

The apparatus 30 further comprises a switch 120 that is in electrical communication with the pump 118 and has an off position in which the pump 118 is not powered, an up position in which the pump 118 causes the piston rod 104 of the hydraulic cylinder 100 to extend and automatically raise the keyboard table 12, and a down position in which the hydraulic cylinder 100 is relieved and the biasing of the coil spring 110 causes the piston rod 104 of the hydraulic cylinder 100 to retract and automatically lower the keyboard table 12.

It will be understood that each of the elements described above, or two or more together, may also find a useful application in other types of constructions differing from the types described above.

While the invention has been illustrated and described as embodied in a device for automatically adjusting the height of a keyboard table of a console enclosure, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A device for automatically adjusting the height of a keyboard table of a console of the type having a base containing a pair of spaced-apart and vertically-oriented partitions comprising: a pair of interchangeable and oppositely arranged key board supporting assemblies mounted to said console, each supporting assembly comprising:

a) a vertical track;

b) a stationary stop fixedly disposed at the lower end of said track;

c) a vertically movable frame mounted in said track said keyboard table being replaceably attached to said movable frame for conjoint movement therewith; and d) means for automatically and selectively moving said movable frame and the keyboard table so as to allow the keyboard table to automatically be placed at an elevation comfortable for various users of the console without having to manually remove and relocate the keyboard comprising, a hydraulic cylinder for raising said movable frame and keyboard table and a coil spring secured at one end to said movable frame and at the other end to said stationary frame, said spring being biased to cause said hydraulic cylinder to automatically retract thereby lowering said movable frame and keyboard table.

2. The device as defined in claim 1, wherein said track is substantially C-shaped, vertically-oriented, and whose web abuts against, and is for replaceable mounting to, a respective partition of the pair of partitions.

3. The device as defined in claim 2, wherein said web of said track is replaceably mounted to the respective partition of the pair of partitions by screws passing through throughbores therealong.

4. A device for automatically adjusting the height of a keyboard table of a console enclosure comprising:

a pair of spaced vertical partitions, each of said partitions having a pair of vertically spaced apart, horizontally oriented, oblong shaped throughslots;

a pair of interchangeable and oppositely arranged sub-units mounted to said partitions respectively, each sub-unit comprising:

a substantially C-shaped vertical track having a web that abuts against, and is for replaceably mounting to, one of said partitions;

a vertically oriented, channel shaped, stationary frame fixedly disposed in said track, said frame having a web that faces said web of said track and a pair of spaced flanges extending perpendicularly from said web, said web having four pairs of vertical spaced throughbores;

a movable frame mounted in said track for vertical movement therein and for having said keyboard table replaceably attached thereto for vertical movement therewith; and means for automatically and selectively moving said movable frame and the keyboard table replaceably attached thereto vertically so as to allow the keyboard table to automatically be at an elevation comfortable for various users of the same console enclosure without having to manually remove and relocate the keyboard table.

5. The device as defined in claim 4, wherein said pair of flanges of said stationary frame are welded to said track.

6. The device as defined in claim 5, wherein each flange of said pair of flanges has a plurality of longitudinally spaced throughbores.

7. The device as defined in claim 6, wherein said stationary frame further comprises a lower spring retainer having a mounting portion with a plurality of longitudinal spaced throughbores therethrough and a retainer portion extending perpendicularly from said mounting portion, said retainer portion having a lower end with an upper edge that is concave-shaped and a lower edge with a vertical notch therein.

8. The device as defined in claim 7, wherein said mounting portion is adjustably affixed to a rearmost flange of said pair of flanges of said stationary frame.

9. The device as defined in claim 8, wherein said mounting portion is adjustably affixed to one of said pair of flanges by at least one bolt passing through one of said plurality of throughbores in said mounting portion of said lower spring retainer and through an aligned throughbore of said plurality of throughbores in said rearmost flange.

10. The device as defined in claim 9, wherein said movable frame comprises a vertically oriented plate slidably mounted in said track and a pair of friction reducing bars replaceably affixed to said plate.

11. The device as defined in claim 10, wherein said pair of friction reducing bars are replaceably affixed to said plate of said movable frame by screws.

12. The device as defined in claim 11, wherein said plate of said movable frame has a ledge extending therefrom, said ledge having a pair of longitudinally spaced throughbores.

13. The device as defined in claim 12, wherein said movable frame further comprises a channel shaped keyboard table engaging member having a web and a pair of flanges extending perpendicularly therefrom.

14. The device as defined in claim 13, wherein said pair of flanges of said keyboard table engaging member are welded to said plate of said movable frame.

15. The device as defined in claim 14, wherein each flange of said pair of flanges of said keyboard table engaging member has a plurality of longitudinally spaced throughslots.

16. The device as defined in claim 15, further comprising a pair of gusset plates for supporting said keyboard table, each of said gusset plates having a plurality of keys extending therefrom for inserting into said plurality of longitudinally spaced throughslots in said pair of flanges of said keyboard table engaging member.

17. The device as defined in claim 16, wherein said plurality of throughslots in each flange of said keyboard table engaging member, consist of five throughslots, four for replaceably receiving said keys extending from said gusset plates and a center one for receiving a sliding lock extending from an associated gusset plate for maintaining said keys in said four throughslots so as to prevent inadvertent removal of said keyboard table.

18. The device as defined in claim 17, wherein said means for automatically and selectively moving said movable frame and said keyboard table replaceably attached thereto includes a hydraulic cylinder replaceably mounted to said web of said stationary frame.

19. The device as defined in claim 18, said hydraulic cylinder having a piston rod with a threaded free end for securing said piston rod to one of said throughbores of said pair of throughbores in said ledge of said plate of said movable frame and is replaceably maintained therein.

20. The device as defined in claim 19, wherein said means for automatically and selectively moving said movable frame and said keyboard table further includes a vertically-oriented coil spring, said coil spring having a lowermost end for engaging said vertical notch in said lower edge of said retainer portion and an uppermost end for engaging one of said throughbores of said pair of throughbores in said ledge of said plate of said movable frame.

21. The device as defined in claim 20, wherein said means for automatically and selectively moving said movable frame and said keyboard table further includes a fluid reservoir that is in fluid communication with said hydraulic cylinder, and a pump powered by a AC power source operatively connected to said reservoir.

22. The device as defined in claim 21, wherein said means for automatically and selectively moving said movable frame and said keyboard table further includes a switch in electrical communication with said pump.

* * * * *